US009099268B2

(12) United States Patent
Öberg et al.

(10) Patent No.: US 9,099,268 B2
(45) Date of Patent: Aug. 4, 2015

(54) BYPASS SWITCH ASSEMBLY

(75) Inventors: Åke Öberg, Uppsala (SE); Filippo Chimento, Västerås (SE); Jian Qin, Västerås (SE); Liwei Wang, Kelowna (CA); Ola Jeppsson, Västerås (SE)

(73) Assignee: ABB TECHNOLOGY LTD, Zürich (CH)

( * ) Notice: Subject to any disclaimer, the term of this patent is extended or adjusted under 35 U.S.C. 154(b) by 0 days.

(21) Appl. No.: 14/401,999

(22) PCT Filed: Jun. 13, 2012

(86) PCT No.: PCT/EP2012/061208

§ 371 (c)(1),
(2), (4) Date: Nov. 28, 2014

(87) PCT Pub. No.: WO2013/185815

PCT Pub. Date: Dec. 19, 2013

(65) Prior Publication Data

US 2015/0108091 A1 Apr. 23, 2015

(51) Int. Cl.

| | |
|---|---|
| ***H01H 31/32*** | (2006.01) |
| ***H01H 33/90*** | (2006.01) |
| ***H01H 39/00*** | (2006.01) |
| ***H01H 33/26*** | (2006.01) |
| ***H01H 33/91*** | (2006.01) |

(52) U.S. Cl.

CPC ..... *H01H 33/905* (2013.01); *H01H 33/26* (2013.01); *H01H 33/91* (2013.01); *H01H 39/004* (2013.01); *H01H 2033/906* (2013.01); *H01H 2033/912* (2013.01)

(58) Field of Classification Search

CPC ..... H01H 31/003; H01H 33/6606; H01H 39/004; H01H 31/32; H01H 2033/6668; H01H 33/668

See application file for complete search history.

(56) References Cited

U.S. PATENT DOCUMENTS

| | | | | |
|---|---|---|---|---|
| 3,891,862 | A * | 6/1975 | Clark | 307/125 |
| 3,924,719 | A * | 12/1975 | Bowman | 194/240 |
| 4,296,285 | A | 10/1981 | Lang et al. | |
| 5,164,693 | A * | 11/1992 | Yokoyama et al. | 335/14 |
| 7,122,759 | B2 * | 10/2006 | Moser et al. | 218/79 |
| 7,528,332 | B1 * | 5/2009 | Via et al. | 200/82 B |
| 2004/0184211 | A1 | 9/2004 | Bender et al. | |
| 2010/0219162 | A1 * | 9/2010 | Gentsch | 218/121 |

FOREIGN PATENT DOCUMENTS

| | | |
|---|---|---|
| DE | 94 19 141 U1 | 3/1996 |
| WO | WO 2010/081555 A1 | 7/2010 |

* cited by examiner

*Primary Examiner* — Truc Nguyen

(74) *Attorney, Agent, or Firm* — Birch, Stewart, Kolasch & Birch, LLP

(57) ABSTRACT

A mechanical switch in the form of a bypass switch assembly is arranged between two electrical conductors (busbars) and stays open during normal operation. When a cell fault happens, the fault and bypass information is transmitted to an actuator (acting as a trigger circuit) which activates inter alia a gas generator producing huge volume of gas in a very short time. The gas pressure pushes a movable member to bridge the two electrical conductors with ultrafast speed.

20 Claims, 6 Drawing Sheets

BYPASS SWITCH ASSEMBLY

TECHNICAL FIELD

The invention relates to a bypass switch assembly for a semiconductor module.

BACKGROUND

In high-voltage, direct current (HVDC) electric power transmission systems direct current (DC) is used for the bulk transmission of electrical power, in contrast with the more common alternating current systems. A flexible alternating current transmission system (FACTS) is a system composed of static equipment used for alternating current (AC) transmission of electrical energy. FACTS is meant to enhance controllability and increase power transfer capability of the network. It is generally a power electronics-based system.

An arc fault may generally be described as a high power discharge of electricity between two or more conductors. This discharge usually translates into heat, which can break down the conducting wire's insulation and possibly trigger an electrical fire. These arc faults can range in current from a few amps up to hundreds of thousands of amps high and are highly variable in terms of strength and duration. Common causes of arc faults include faulty connections due to corrosion faulty initial installation, and semiconductor failures in the converter. In the improbable case of an internal fault (fault arc or arc fault) in any of the above described systems, installation safety and personal safety must be ensured.

In the context of power electronics converter systems used in motor drive industries, HVDC and FACTS, modular converter cells are applied as building blocks of power converter systems. Modular converter systems usually have multiple redundant power cells for a reliable operation of the system. Therefore, when one cell fails during fault, the entire converter system should be able to continue operating until the next scheduled maintenance. To ensure the continued converter operation without breakdown, the faulty cells should be bypassed inter alia by means of electrically connecting two busbars with very fast speed. During healthy condition, the two busbar terminals should be properly insulated to avoid any accidental short-circuit fault.

In the present design of semiconductor modules for HVDC electric power transmission systems and FACTS, failures are handled by an internal short circuit mode. Future constructions may need external ("bypass") short-circuit modes to handle certain failure situations.

In some arc-quenching bypass switches, additional insulation layers or membranes are used to provide extra separation between two busbar contacts. The insulation layers are typically made of ceramics or general-purpose thermal plastics.

SUMMARY

Semiconductor modules in HVDC and FACTS applications need to have a safe handling of short circuit failures. An object of embodiments herein is therefore to provide a safety arrangement for a semiconductor module in HVDC or FACTS electric power transmission systems. The inventors of the enclosed embodiments have through a combination of practical experimentation and theoretical derivation discovered that one way of handling such failures, is to connect a mechanical bypass switch parallel to the semiconductor module to secure a stable bypass of the current until the replacement of the failed semiconductor module takes place at the next service event. Such bypass switches are likely to occur in large numbers in the different valve designs, and they should therefore preferably be compact, easy to handle, fast and inexpensive.

A particular object is therefore to provide a bypass switch assembly for a semiconductor module. According to a first aspect there is presented a bypass switch assembly for a semiconductor module, comprising a housing, the housing comprising a first electrical conductor; a second electrical conductor; and a chamber; an electrical insulator; a movable member placed in said chamber and movable between a first position and a second position, wherein the member in the first position is in electrical contact with at most one of said first electrical conductor and said second electrical conductor, and wherein the movable member in the second position is in electrical contact with both said first electrical conductor and said second electrical conductor; the bypass switch assembly further comprising an actuator arranged to move said movable member from said first position to said second position, thereby causing said movable member to bypass said electrical insulator; and gas relief means arranged to release gas from said chamber upon movement of said movable member.

The disclosed bypass switch assembly is advantageous in that it allows for a simple and compact construction. The disclosed bypass switch assembly is further advantageous in that it is easy to assemble. The disclosed bypass switch assembly is further advantageous in that it may be made from low-cost parts.

The actuator is preferably one from a group of a gas generator, a loaded spring, an electromagnetic launcher, and an explosive capsule. The actuator itself enables easy and simple initiation of the movement of the movable member. The gas generator is particularly advantageous in that it will produce a very short action time. The loaded spring is particularly advantageous in that it allows for a simple and cost-effective solution. The electromagnetic launcher is particularly advantageous in that it allows for simple supervision of the actuator. The explosive capsule is particularly advantageous in that it allows for a large force to be produced, thereby enabling the moveable member to be moved at a particularly high speed.

According to embodiments the chamber is filled with a gas from a group of $CO_2$, $SF_6$, $N_2$, $H_2$ and air, the gas in the chamber forming the electrical insulator. Gas forming the electrical insulator advantageously allows for a simple electrical insulator.

According to embodiments the electrical insulator is a solid insulator placed between the first electrical conductor and the second electrical conductor. This advantageously enables even further isolation between the first electrical conductor and the second electrical conductor.

According to embodiments the electrical insulator is a polymer film. This advantageously allows the first electrical conductor and the second electrical conductor to have minimum separation whilst still enabling the first electrical conductor and the second electrical conductor to be electrically isolated, thereby allowing for a compact construction of the bypass switch assembly.

Other objectives, features and advantages of the enclosed embodiments will be apparent from the following detailed disclosure, from the attached dependent claims as well as from the drawings.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated.

BRIEF DESCRIPTION OF THE DRAWINGS

Embodiments of the invention will now be described, by way of non-limiting examples, references being made to the accompanying drawings, in which.

DETAILED DESCRIPTION

The invention will now be described more fully hereinafter with reference to the accompanying drawings, in which certain embodiments of the invention to are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout the description.

Figure 17:
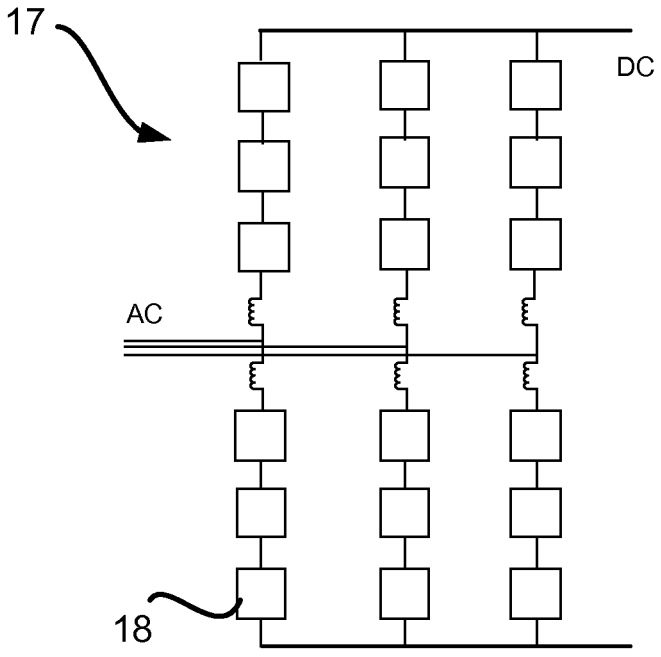
FIGS. 17-19 schematically illustrate modular multilevel converters in which the bypass switch assembly illustrated in any one of FIGS. 1-10 may be used.
Figure 18:
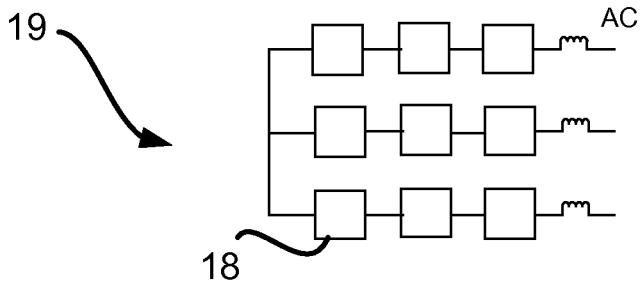
Figure 19:
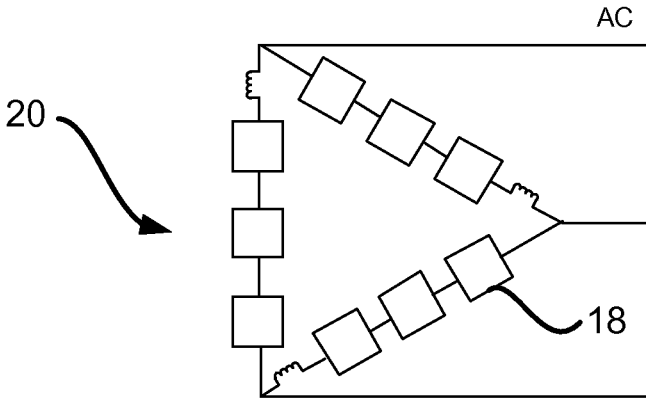

FIGS. 1-10 illustrate different embodiments of a bypass switch assembly 1 for a semiconductor module and may in general terms be denoted a short-circuiting device. FIGS. 17-19 schematically illustrate modular multilevel converters in which the bypass switch assembly illustrated in any one of FIGS. 1-10 may be used. As such the bypass switch assembly 1 may preferably be used for quenching a fault arc. In general the bypass switch assembly 1 may be used for bypassing faulty semiconductors such as Insulated-gate bipolar transistors (IGBTs) and/or converter modules in power converters for HVDC, FACTS and electrical drives. When a semiconductor module fails during short-circuit condition, the semiconductor module may be damaged and cause an electrical arc. The bypass switch assembly 1 is then used to quench the arc.

The bypass switch assembly 1 for a semiconductor module illustrated in FIGS. 1-10 will now be described in more detail.

In general terms, the bypass switch assembly 1 is preferably based on a polymeric tube in which tubular copper conductors 7, 8 are fitted. More particularly the bypass switch assembly 1 comprises a housing 3 in which a number of components may be provided. More particularly, the housing 3 comprises a first electrical conductor 7 and a second electrical conductor 8. The housing 3 further comprises a chamber 4. According to one preferred embodiment the chamber 4 is filled with gas (thus according to this preferred embodiment the chamber 4 may also be denoted as a gas filled chamber). The housing 3 further comprises a movable member 5. In general terms the first to conductor 7 and the second conductor 8 are electrically connectable by means of the movable member 5. The bypass switch assembly 1 further comprises an actuator 6 for moving (as illustrated by reference numeral 11) the movable member 5 and gas relief means 2 for releasing gas from the chamber 4.

Figure 4:
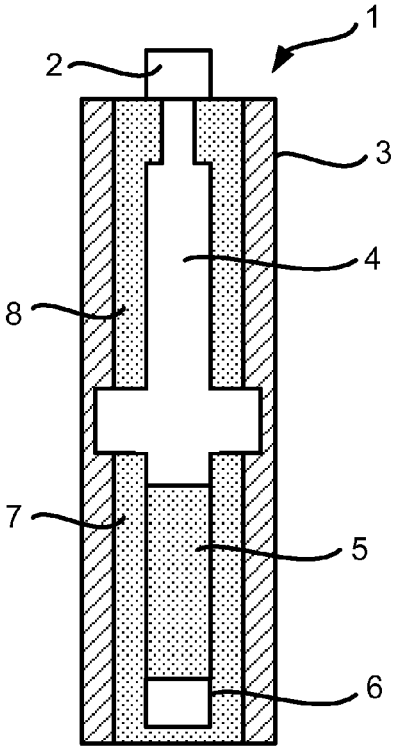
Figure 5:
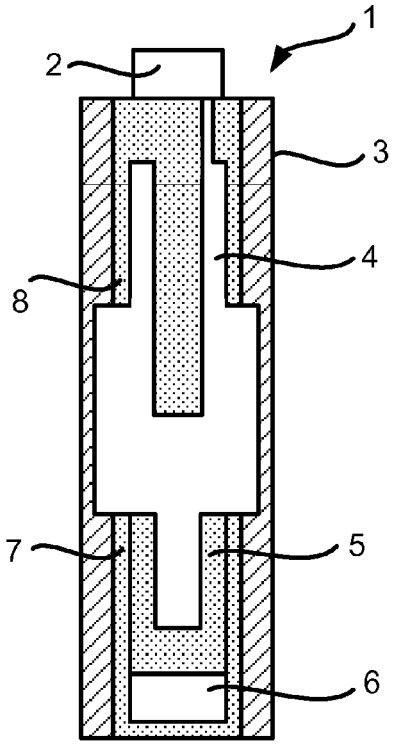
Figure 6:
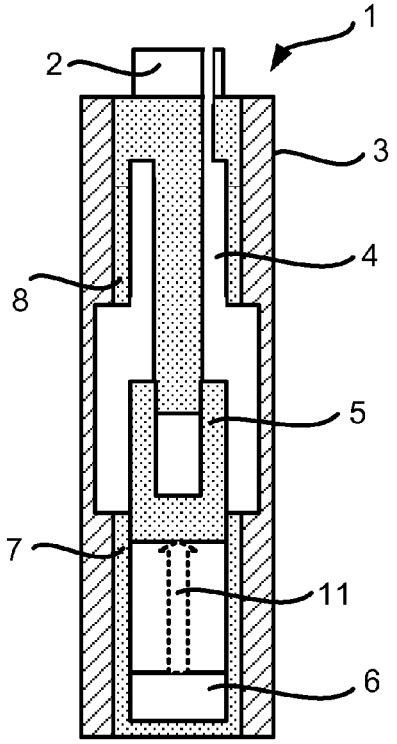

The chamber 4 may generally be defined by the space spanned by the (inner) walls of the housing 3. The walls of the housing 3 that face the chamber 4 are preferably made from a polymer. In general, the insulation system of the bypass switch assembly 1 may according to embodiments be defined exclusively by gas in the chamber 4 (as illustrated in FIGS. 4, 5 and 6). In general terms the insulation system may according to some embodiments thus be said to comprise an insulating gas enclosed by polymer walls. The gas in the chamber 4 is preferably $CO_2$ or $SF_6$. Alternatively the gas in the chamber 4 is air.

Figure 7:
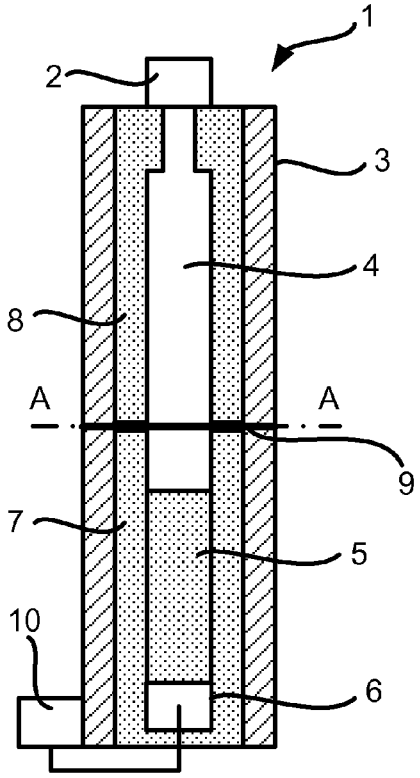
Figure 8:
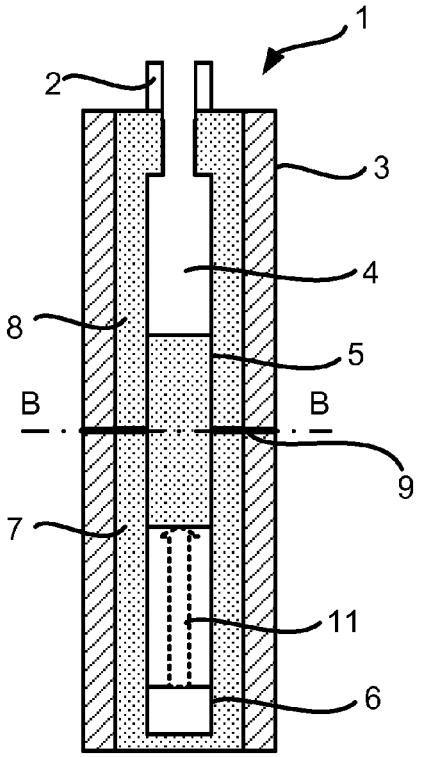
Figure 15:
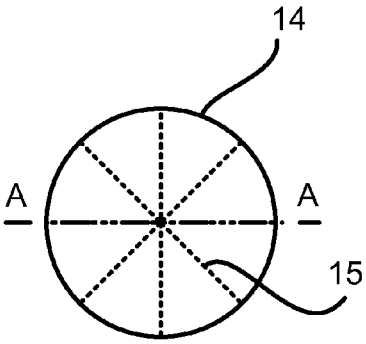
FIGS. 15-16 schematically illustrate a thin polymer film for use with a bypass switch assembly according to some embodiments.
Figure 16:
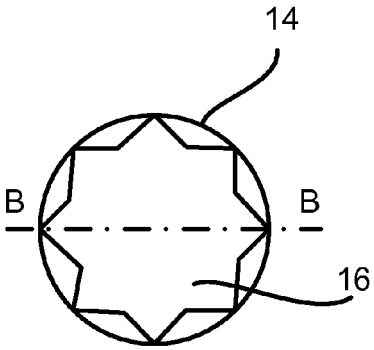

According to some embodiments the bypass switch assembly 1 further comprises a solid insulator 9 (as illustrated in FIGS. 1, 2, 3, 7, 8, 9 and 10). The solid insulator 9 is preferably placed between the first electrical conductor 7 and the second electrical conductor 8. According to one preferred embodiment (as illustrated in FIGS. 1, 2, 3, 9 and 10) the solid insulator 9 has a through hole through which the movable member is movable. According to this embodiment the solid insulator 9 is preferably part of the housing 3. According to another preferred embodiment (as illustrated in FIGS. 7 and 8) the solid insulator 9 is made from a thin polymer film 14 (as illustrated in FIGS. 15 and 16). Preferably the polymer film 14 has a thickness of 0.1-2.0 mm, even more preferably 0.1-1.0 mm. According to the embodiment of FIGS. 7 and 8 the first electrical conductor 7 and the second electrical conductor 8 (i.e. the two busbars) are thus insulated by an insulation layer in the form of a polymer film 14 instead of just free air or a gas. This allows the clearing distance between the first electrical conductor 7 and the second electrical conductor 8 to be reduced, thereby allowing for a more compact construction of the bypass switch assembly 1. FIG. 15 illustrates a solid insulator 9 in the form of a thin polymer film 14 as viewed along the cut A-A of FIG. 7. FIG. 16 illustrates the thin polymer film 14 as viewed along the cut B-B of FIG. 8, thus after it has been penetrated by the movable member 5 (not illustrated in FIG. 16), thereby creating a void 16 in the polymer film 14. The insulation layer 9 is according to this embodiment composed of a thin polymer film 14 with good insulation/dielectric strength. It should provide sufficient electrical breakdown resistance and long-term stability against aging. To facilitate easy break of the polymer film 14 by the movable member 5, specially designed patterns 15 can be introduced on the polymer film 14 which patterns 15 can generate local stress inhomogeneity to guide the punching through by the movable member 5. After the insulation layer 14 has been broken (as in FIGS. 8 and 16), the polymer film 14 can be vaporized by the heat generated at the electrical contact between the movable member 5, the first electrical conductor 7 and the second electrical conductor 8 so that no debris or remnant can block the electrical contact thus established. When the bypass switch assembly 1 is used at the DC side of a converter cell (as DC bypass), the vaporization of the polymer film is even easier due to the hundreds of kilo Amperes discharging surge current of the DC link capacitor.

The movable member 5 may be a projectile-type member. For example, when closing the switch, the projectile-type member may be shot between the electrical conductors 7, 8 to make friction welds 20*a*, 20*b*, 20*c*, 20*d* which will form a stable short circuit of the module. The first electrical conductor 7 may thus further comprise one or more friction weld zones 20*a*, 20*b* for being in contact with the movable member 5 in the second position. Further, the second electrical conductor 8 may thus further comprise one or more friction weld zones 20*c*, 20*d* for being in contact with the movable member 5 in the second position. The friction weld zones 20*a-d* are thus advantageous in that they may ensure an electrical connection between the first electrical conductor 7 and the second electrical conductor 8 via the movable member 5.

Figure 9:
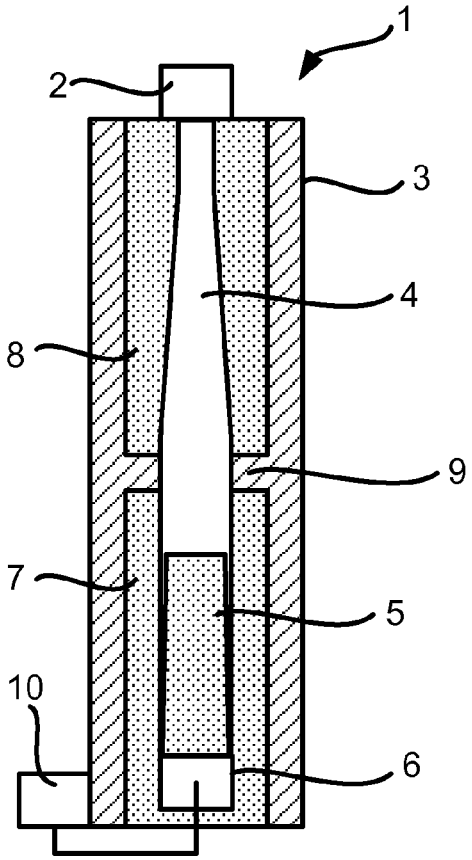
Figure 10:
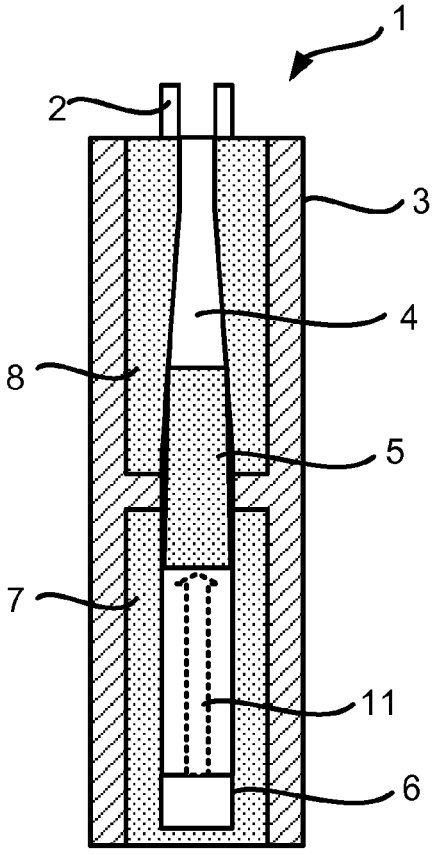

Further, the second electrical conductor 8 and/or the movable member 5 may have a conical shape (as illustrated in FIGS. 9 and 10). The conical shape thereby acts as a mechanical clamping device to secure the connection of the movable member 5 and the second electrical conductor 8 in the second state According to a first preferred embodiment (as illustrated in FIGS. 1, 2, 3, 4, 7, 8, 9 and 10) the movable member 5 thus is a piston. According to this first preferred embodiment the first electrical conductor 7 and the second electrical conductor 8 preferably have the shape of cylinders, even more preferably having conical shapes. The movable member 5 in the second position is thereby arranged to engage with the second electrical conductor 8 by at least partly entering the cylinder. The movable member 5 is thereby arranged to be in electrical contact with the second electrical conductor.

According to a second preferred embodiment (as illustrated in FIGS. 5 and 6) the movable member 5 is a cylinder. According to this second preferred embodiment the second electrical conductor 8 preferably has the shape of a piston. The movable member 5 in the second position is thereby arranged to engage with the second electrical conductor 8 by at least partly enclosing the piston. The movable member 5 is thereby arranged to be in electrical contact with the second electrical conductor 8.

Gas relief means 2 are provided to release gas from the chamber 4 upon actuation of the movable member 5 in order to secure a fast travel of the movable member 5 and to avoid gas pressure build-up in the chamber 4. The gas relief means 2 is thus preferably synchronized to the closing of the switch. According to a preferred embodiment the gas relief means 2 is a pressure relief valve. The pressure relief valve is thus preferably arranged to be opened upon activation of the movable member 5.

According to one embodiment each end of the bypass switch assembly 1 is connected to a cooler in the valve thereby connecting it parallel to a module.

The bypass switch assembly 1 may further comprise detection means 10. The detection means to are arranged to detect an electrical failure. Upon detection of the electrical failure, the detecting means to are preferably arranged to trigger the actuator 6 so as to close the switch. The detection means to are further preferably arranged to activate the gas relief means 2 to release gas from the chamber 4. The detection means to are preferably arranged such that activation of the gas relief means 2 are synchronized with to triggering of the actuator 6. The detection means to may be provided as part of a control circuit.

Operation of the bypass switch assembly 1 for a semiconductor module illustrated in FIGS. 1-10 will now be described in more detail.

Figure 1:
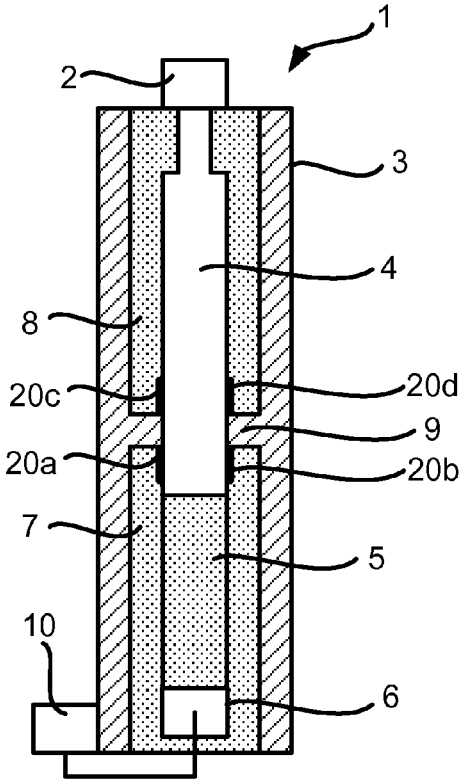
FIGS. 1-10 schematically illustrate different embodiments of a bypass switch assembly.
Figure 2:
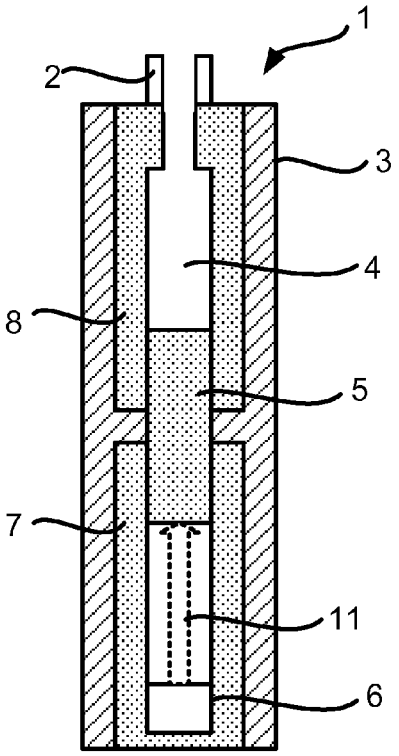
Figure 3:
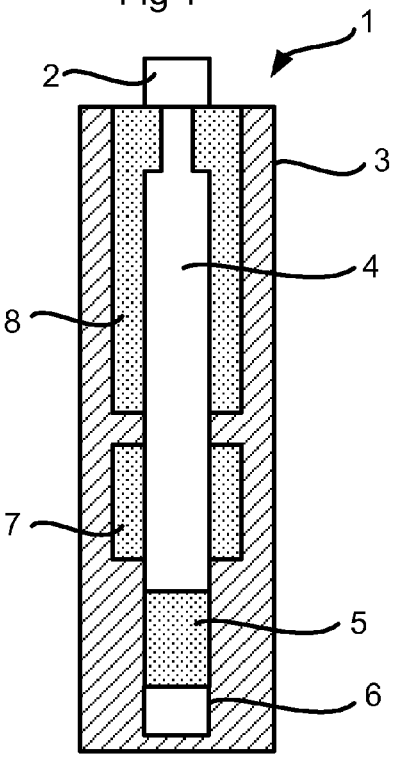

As noted above, the preliminary purpose of the bypass switch assembly 1 is to quench a fault arc in the faulty power electronic converter modules when semiconductor devices are failed whereby, as a result of a switch in the bypass switch assembly 1 being closed, a number of faulty power electronic converter modules used in HVDC and FACTS electric power transmission systems are bypassed. In order to do this the movable member 5 is moved from a first position (as in FIGS. 1, 3, 4, 5, 7, 9) to a second position (as in FIGS. 2, 6, 8, 10) so as to close the switch. In general terms the second position may therefore be viewed as corresponding to a conducting state whereas the first position may be viewed as corresponding to an insulating state. In the first position the movable member 5 is in electrical contact with at most one of the first electrical conductor 7 and the second electrical conductor 8. In FIG. 3 the movable member 5 is neither in contact with the first electrical conductor 7 nor with the second electrical conductor 8. In the second position the movable member 5 is in electrical contact with both the first electrical conductor 7 and the second electrical conductor 8. Without loss of generality it will in the following be assumed that the movable member 5 in the first position is not in electrical contact with the second electrical conductor 8.

Thus, a mechanical switch in the form of the disclosed bypass switch assembly 1 is arranged between two electrical conductors 7, 8 (i.e. busbars) and stays open during normal operation. When a cell fault happens, the fault and bypass information will be transmitted to the actuator 6 (acting as a trigger circuit) which activates inter alia a gas generator producing huge volume of gas in a very short time. The gas pressure pushes the movable member 5 inter alia to break an insulation layer 14 and to bridge the two electrical conductors 7, 8 with ultrafast speed in less than one millisecond. The high demand for closing speed is due to the risk for explosion in the converter cell.

There are a number of ways to close the switch. In general, the switch is closed by the movable member 5 being moved from its first position to its second position (as illustrated by reference numeral 11). There are a number of ways to move the movable member 5 from its first position to its second position. In general the movable member 5 is movable from its first position to its second position by means of an actuator 6.

FIGS. 11-14 schematically illustrate different embodiments of an actuator 6 for a bypass switch assembly 1 as illustrated in any one of FIGS. 1-10. In FIGS. 11-14 the movable member 5 has been moved towards the second position.

Figure 11:
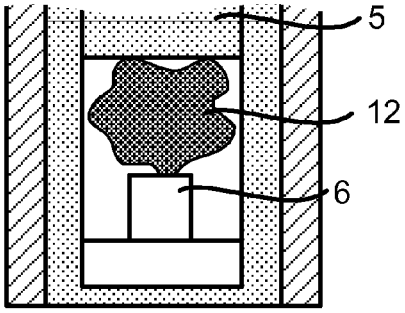
FIGS. 11-14 schematically illustrate different embodiments of an actuator for a bypass switch assembly as illustrated in any one of FIGS. 1-10.

According to a first preferred embodiment (as illustrated in FIG. 11) the actuator 6 is a gas generator. Upon activation of the gas generator, gas 12 is released from the gas generator. The movable member 5 is thus moved from its first position to its second position by means of the pressure created by the gas 12 released from the gas generator.

Figure 12:
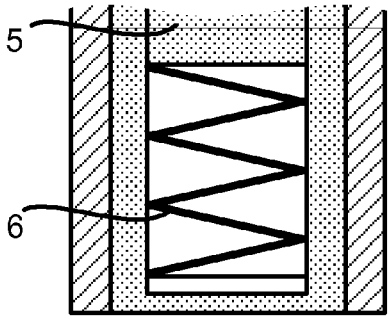

According to another embodiment (as illustrated in FIG. 12) the actuator 6 is a loaded spring. Upon release of the loaded spring the movable member is, as a consequence of the loaded spring being un-loaded, moved from its first position to its second position.

Figure 13:
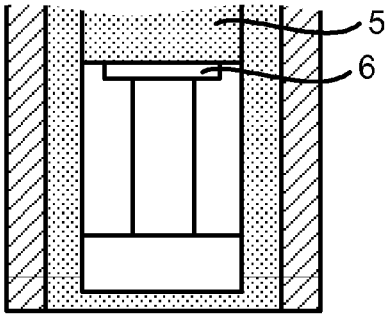

According to another embodiment (as illustrated in FIG. 13) the actuator 6 is an electromagnetic launcher, such as a Thomson coil. For example, the actuator 6 may comprise an induction coil connectable to an AC power source and a metal ring. During operation the metal ring is placed over the core of the induction coil. When the induction coil is connected to an AC power source the ring will be released from the induction coil, thus acting as an actuator for the movable member 5. Thus, upon activation of the Thomson coil the movable member i5 s moved from its first position to its second position by the ring.

Figure 14:
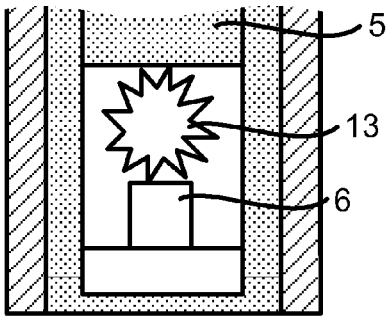

According to another embodiment (as illustrated in FIG. 14) the actuator 6 is an explosive capsule. Activation of the explosive capsule causes the capsule to explode 13 or at least expand, the explosive forces thereof thereby forcing the movable member 5 to be moved from its first position to its second position.

FIG. 17 shows a modular multilevel converter used in a voltage source converter (VSC) HVDC transmission. The VSC HVDC modular multilevel converter uses modular cells, one of which in FIG. 17 is identified by reference numeral 18.

Figure 21:
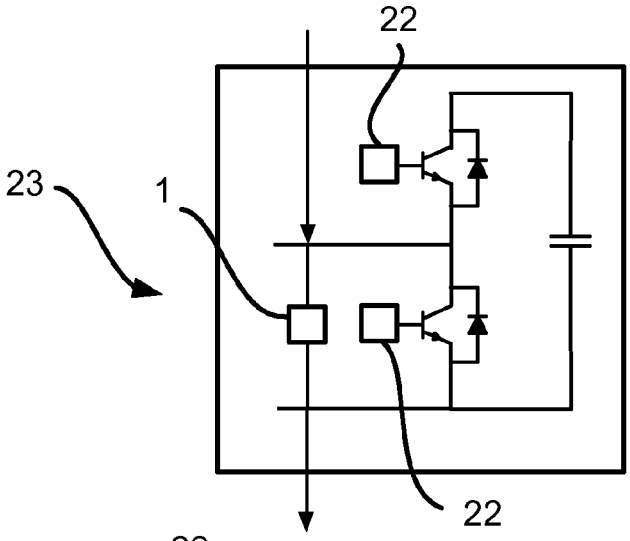
Figure 22:
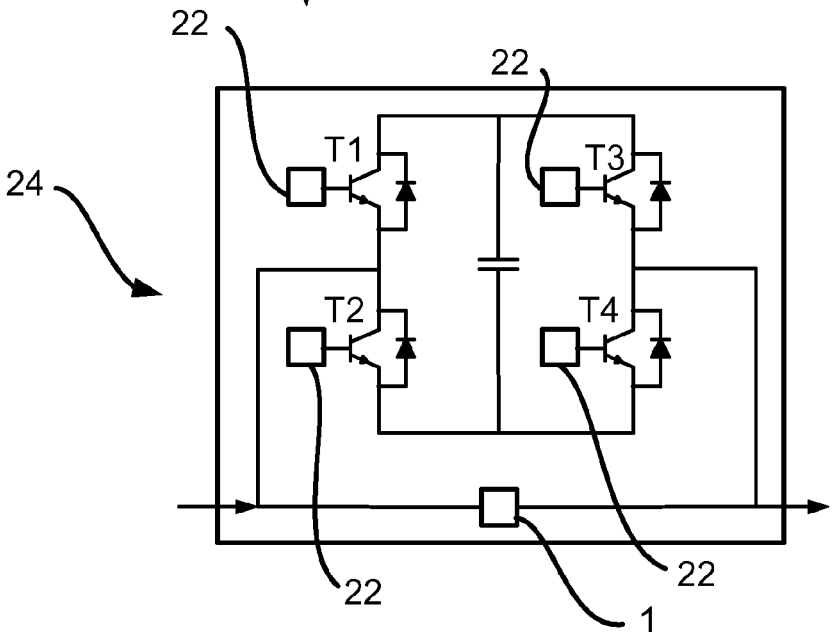

The modular cells 18 can be various types. Three examples are provided in FIGS. 20, 21 and 22. The modular multilevel converter is designed to have some redundant cells 18 so that, if some cells 18 are failed or malfunction, the bypass switch assembly 1 can bypass the faulty cells soon after detection of the faulty cells 1 (by arc sensors, voltage or current measurements). Thereby the converter station as a whole can still operate without disruption.

Figure 20:
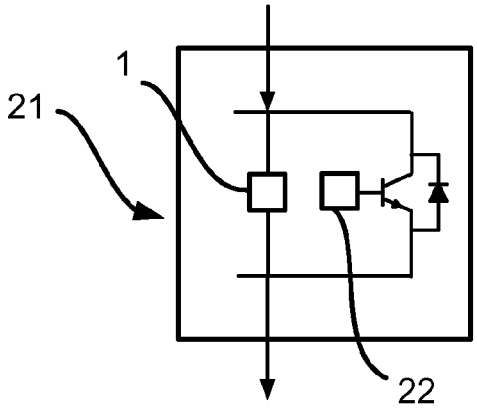
FIGS. 20-22 schematically illustrate modular cells for the modular multilevel converters of FIGS. 17-19.

The cell 21 of FIG. 20 (denoted cell type 1) is a single semiconductor module for use with, for example, an insulated-gate bipolar transistor (IGBT). The IGBT is triggered by a gate unit 22. The cell 23 of FIG. 21 (denoted cell type 2) is a half bridge converter module comprising two IGBT triggered by gate units 22. The cell 24 of FIG. 22 (denoted cell type 3) is a full bridge converter module wherein each one of the IGBTs T1, T2, T3, T4 is triggered by its own gate unit 22. As noted by the skilled person these are just three examples of cell types and the disclosed bypass switch assembly 1 may function equally well with other types of cells.

There are FACTS/static var compensators (SVC) for reactive power compensation applications where multilevel converter cells 18 are used. Two typical converter circuits (so-called chain-link converters) are shown in FIGS. 18 and 19. One type of converter is an Y connected chain-link converter 19 as illustrated in FIG. 18. Another type of converter is delta connected chain-link converter 20 as illustrated in FIG. 19. The converter cell type 3—i.e., the full-bridge converter module, is advantageously used in FACTS chain-link converters. When one cell fails, the bypass switch assembly 1 bypasses the faulty cells to ensure the continuous and reliable operation of the converter as a whole.

The invention has mainly been described above with reference to a few embodiments. However, as is readily appreciated by a person skilled in the art, other embodiments than the ones disclosed above are equally possible within the scope of the invention, as defined by the appended patent claims. For example, although the bypass switch assembly according to a preferred embodiment has been disclosed as comprising a housing comprising the first electrode, the second electrode, the chamber and the movable member, the housing could, according to one embodiment also be replaced by an open structure with air being the insulating gas.

The invention claimed is:

1. A bypass switch assembly for a semiconductor module, comprising a housing, the housing comprising a first electrical conductor;

a second electrical conductor; and a chamber; wherein said chamber is filled with a gas from a group of $CO_2$, $SF_6$, $N_2$, $H_2$ and air, an electrical insulator formed by said gas;

a movable member placed in said chamber and movable between a first position and a second position, wherein the member in the first position is in electrical contact with at most one of said first electrical conductor and said second electrical conductor, and wherein the movable member in the second position is in electrical contact with both said first electrical conductor and said second electrical conductor;

the bypass switch assembly further comprising an actuator arranged to move said movable member from said first position to said second position, thereby causing said movable member to bypass said electrical insulator; and gas relief means in the form of a pressure relief valve arranged to release gas from said chamber upon movement of said movable member detection means for detecting electrical failure, said detecting means activating the gas relief means synchronised with triggering said actuator upon detection of the electrical failure.

2. The bypass switch assembly according to claim 1, wherein said actuator is one from a group of a gas generator, a loaded spring, an electromagnetic launcher, and an explosive capsule.

3. The bypass switch assembly according to claim 1, wherein said movable member is a piston.

4. The bypass switch assembly according to claim 1, wherein said movable member is a cylinder.

5. The bypass switch assembly according to claim 1, wherein said first electrical conductor and/or said second electrical conductor further comprises one or more friction weld zones for being in contact with said movable member in said second position.

6. The bypass switch assembly according to claim 1, wherein said second electrical conductor and/or said movable member has a conical shape such that said movable member in said second position engages with said second electrical conductor in a clamping grip.

7. The bypass switch assembly according to claim 1, wherein walls of said housing facing said chamber are made from a polymer.

8. The bypass switch assembly according to claim 1, wherein said housing is a tube.

9. The bypass switch assembly according to claim 2, wherein said movable member is a piston.

10. The bypass switch assembly according to claim 2, wherein said movable member is a cylinder.

11. The bypass switch assembly according to claim 2, wherein said first electrical conductor and/or said second electrical conductor further comprises one or more friction weld zones for being in contact with said movable member in said second position.

12. The bypass switch assembly according to claim 3, wherein said first electrical conductor and/or said second electrical conductor further comprises one or more friction weld zones for being in contact with said movable member in said second position.

13. The bypass switch assembly according to claim 4, wherein said first electrical conductor and/or said second electrical conductor further comprises one or more friction weld zones for being in contact with said movable member in said second position.

14. The bypass switch assembly according to claim 2, wherein said second electrical conductor and/or said movable member has a conical shape such that said movable member in said second position engages with said second electrical conductor in a clamping grip.

15. The bypass switch assembly according to claim 3, wherein said second electrical conductor and/or said movable member has a conical shape such that said movable member in said second position engages with said second electrical conductor in a clamping grip.

16. The bypass switch assembly according to claim 4, wherein said second electrical conductor and/or said movable member has a conical shape such that said movable member in said second position engages with said second electrical conductor in a clamping grip.

17. The bypass switch assembly according to claim 5, wherein said second electrical conductor and/or said movable member has a conical shape such that said movable member in said second position engages with said second electrical conductor in a clamping grip.

18. The bypass switch assembly according to claim 2, wherein walls of said housing facing said chamber are made from a polymer.

19. The bypass switch assembly according to claim 3, wherein walls of said housing facing said chamber are made from a polymer.

20. The bypass switch assembly according to claim 4, wherein walls of said housing facing said chamber are made from a polymer.

* * * * *